US005954426A

United States Patent [19]

Whittington

[11] Patent Number: 5,954,426

[45] Date of Patent: Sep. 21, 1999

[54] INTERCHANGEABLE LAMP

[76] Inventor: Anderson H. Whittington, 3048 Cedar Dr., La Marque, Tex. 77568

[21] Appl. No.: 08/985,415

[22] Filed: Dec. 4, 1997

[51] Int. Cl.[6] ..... F21V 21/00

[52] U.S. Cl. ..... 362/414; 362/410; 362/431

[58] Field of Search ..... 362/410, 414, 362/431, 285

[56] References Cited

U.S. PATENT DOCUMENTS

| | | | |
|---|---|---|---|
| 1,150,391 | 8/1915 | Sanford | 362/414 |
| 1,560,289 | 11/1925 | Noll | 362/431 |
| 2,252,395 | 8/1941 | Cohen | 362/431 |
| 2,429,553 | 10/1947 | Jasinski | 362/410 |
| 4,774,648 | 9/1988 | Kakuk et al. | 362/431 |

*Primary Examiner*—Thomas M. Sember

[57] ABSTRACT

A new interchangeable lamp for providing an easily dismantable lamp. The inventive device includes a base having a mounting portion and a resting flange. The invention also includes elongate at least two tubes. The lower end of each tube is mountable to the mounting portion of the base. The substantially transparent lower portion of a housing is detachably couplable to the each of the upper ends of the tubes. Within the housing hollow interior is a light source mounted to the lower portion of the housing for providing light.

10 Claims, 2 Drawing Sheets

INTERCHANGEABLE LAMP

BACKGROUND OF THE INVENTION

1. Field of the Invention

The present invention relates to lamps and more particularly pertains to a new interchangeable lamp for providing an easily dismantable lamp.

2. Description of the Prior Art

The use of lamps is known in the prior art. More specifically, lamps heretofore devised and utilized are known to consist basically of familiar, expected and obvious structural configurations, notwithstanding the myriad of designs encompassed by the crowded prior art which have been developed for the fulfillment of countless objectives and requirements.

Known prior art lamps include U.S. Pat. No. 3,961,176; U.S. Pat. No. 5,236,160; U.S. Pat. No. 4,488,209; U.S. Pat. No. 4,772,993; U.S. Pat. No. 4,425,610; and U.S. Pat. No. Des. 318,138.

While these devices fulfill their respective, particular objectives and requirements, the aforementioned patents do not disclose a new interchangeable lamp. The inventive device includes a base having a mounting portion and a resting flange. The invention also includes elongate at least two tubes. The lower end of each tube is mountable to the mounting portion of the base. The substantially transparent lower portion of a housing is detachably couplable to the each of the upper ends of the tubes. Within the housing hollow interior is a light source mounted to the lower portion of the housing for providing light.

In these respects, the interchangeable lamp according to the present invention substantially departs from the conventional concepts and designs of the prior art, and in so doing provides an apparatus primarily developed for the purpose of providing an easily dismantable lamp.

SUMMARY OF THE INVENTION

In view of the foregoing disadvantages inherent in the known types of lamps now present in the prior art, the present invention provides a new interchangeable lamp construction wherein the same can be utilized for providing an easily dismantable lamp.

The general purpose of the present invention, which will be described subsequently in greater detail, is to provide a new interchangeable lamp apparatus and method which has many of the advantages of the lamps mentioned heretofore and many novel features that result in a new interchangeable lamp which is not anticipated, rendered obvious, suggested, or even implied by any of the prior art lamps, either alone or in any combination thereof.

To attain this, the present invention generally comprises a base having a mounting portion and a resting flange. The invention also includes elongate at least two tubes. The lower end of each tube is mountable to the mounting portion of the base. The substantially transparent lower portion of a housing is detachably couplable to the each of the upper ends of the tubes. Within the housing hollow interior is a light source mounted to the lower portion of the housing for providing light.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new interchangeable lamp apparatus and method which has many of the advantages of the lamps mentioned heretofore and many novel features that result in a new interchangeable lamp which is not anticipated, rendered obvious, suggested, or even implied by any of the prior art lamps, either alone or in any combination thereof.

It is another object of the present invention to provide a new interchangeable lamp which may be easily and efficiently manufactured and marketed.

It is a further object of the present invention to provide a new interchangeable lamp which is of a durable and reliable construction.

An even further object of the present invention is to provide a new interchangeable lamp which is susceptible of a low cost of manufacture with regard to both materials and labor, and which accordingly is then susceptible of low prices of sale to the consuming public, thereby making such interchangeable lamp economically available to the buying public.

Still yet another object of the present invention is to provide a new interchangeable lamp which provides in the apparatuses and methods of the prior art some of the advantages thereof, while simultaneously overcoming some of the disadvantages normally associated therewith.

Still another object of the present invention is to provide a new interchangeable lamp for providing an easily dismantable lamp.

Yet another object of the present invention is to provide a new interchangeable lamp which includes a base having a mounting portion and a resting flange. The invention also includes elongate at least two tubes. The lower end of each tube is mountable to the mounting portion of the base. The substantially transparent lower portion of a housing is detachably couplable to the each of the upper ends of the tubes. Within the housing hollow interior is a light source mounted to the lower portion of the housing for providing light.

Still yet another object of the present invention is to provide a new interchangeable lamp that is dismantable for convenient storage.

Even still another object of the present invention is to provide a new interchangeable lamp that permits the light source to be positioned at various heights according to the circumstances.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
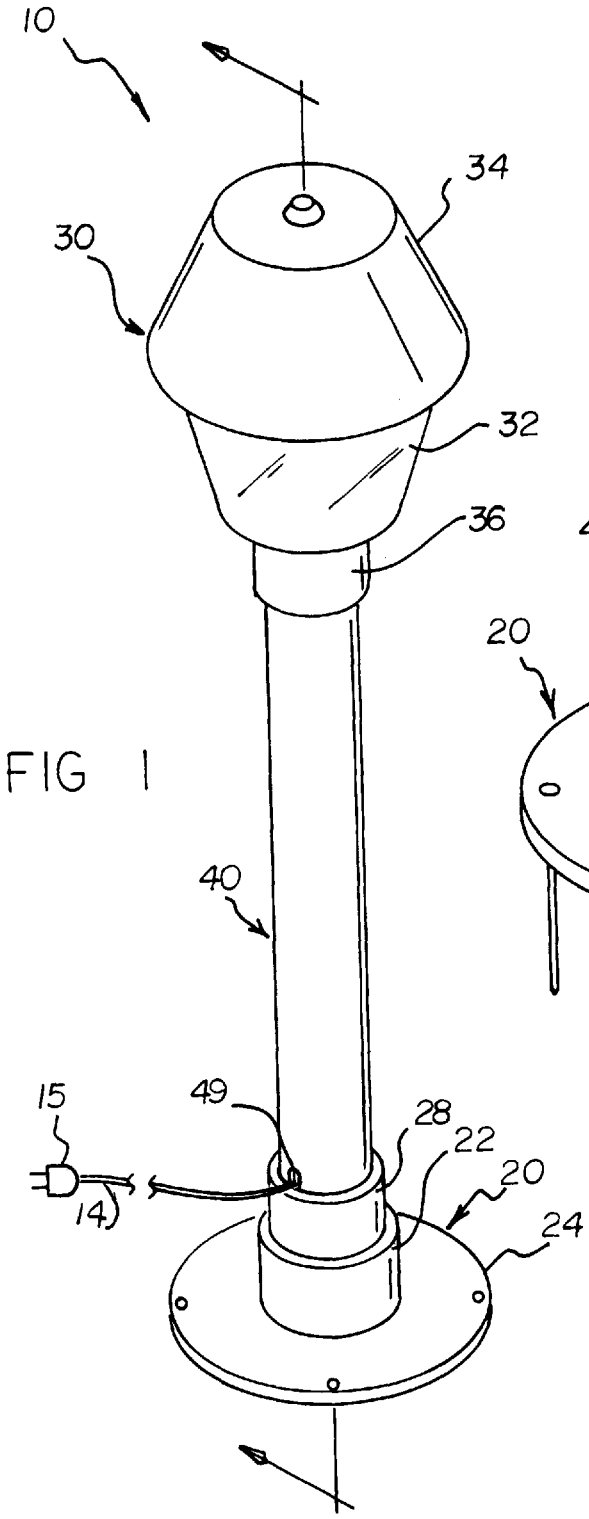
FIG. 1 is a schematic perspective view of a new interchangeable lamp according to the present invention.

With reference now to the drawings, and in particular to FIGS. 1 through 4 thereof, a new interchangeable lamp embodying the principles and concepts of the present invention and generally designated by the reference numeral 10 will be described.

As best illustrated in FIGS. 1 through 4, the interchangeable lamp 10 generally comprises a base 20 having a mounting portion 22 and a resting flange 24. The invention also includes elongate at least two tubes 40. The lower end 48 of each tube 40 is mountable to the mounting portion 22 of the base 20. The substantially transparent lower portion 32 of a housing 30 is detachably couplable to the each of the upper ends 45 of the tubes 40. Within the housing hollow interior 35 is a light source 12 mounted to the lower portion 32 of the housing 30 for providing light.

Figure 2:
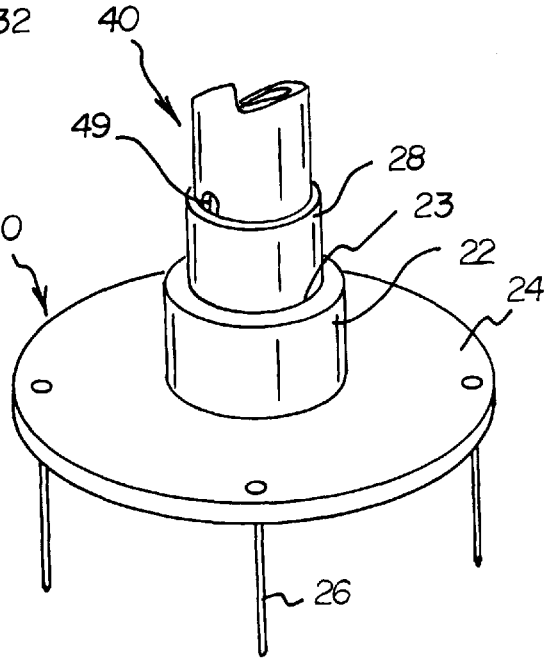
FIG. 2 is a schematic partial perspective view of the base of the present invention.
Figures 3, 4:
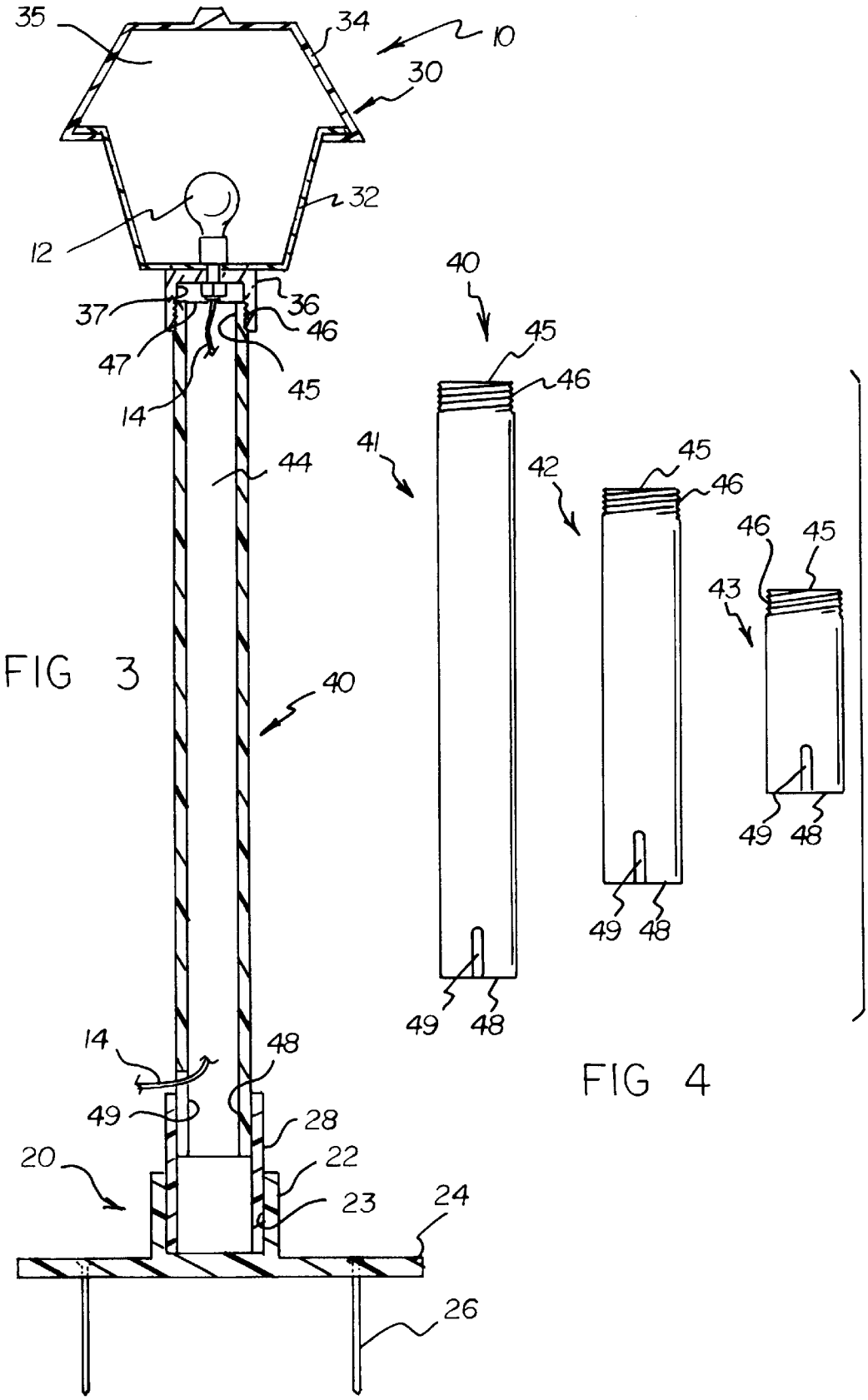
FIG. 3 is a schematic cross-sectional view of the assembled present invention taken from line 4—4 on FIG. 1.
FIG. 4 is a schematic side view of the various lengths of tubes of the present invention.

With reference to FIG. 2, the base has a mounting portion 22 and a resting flange 24 radially extending from the mounting portion 22. The resting flange 24 is designed for resting on a surface. Preferably, a plurality of spaced apart mounting spikes 26 may be downwardly extended from the resting flange 24 and positioned towards the outer periphery of the resting flange 24. The mounting spikes 26 are designed for insertion into a ground surface for helping stability of the lamp 10 when standing upright. With reference to FIG. 3, the mounting portion preferably includes a receiving bore 23. In this preferred embodiment, an elongate annular fitting sleeve 28 is inserted into the receiving bore 23.

As illustrated in FIG. 4, the lamp 10 includes elongate cylindrical first, second and third tubes 41,42,43, with each tube 40 having a hollow interior 44 and opposite upper and lower ends 45,48. The upper end 45 of each the tube 40 is threaded 46 and has having an opening 47 into the hollow interior 44. The lower end 48 of each the tube 40 has a slot 49 into the hollow interior 44 of the tube 40 that extends towards the upper end 45 of the tube 4. The lower end 48 of each the tube 40 is insertable into the bore of the annular fitting sleeve 28 to mount the tube 40 on the mounting portion 22 of the base 20. Preferably, the lower end 48 is insertable into the fitting sleeve 28 such that a portion of the slot 49 of tube 40 is upwardly extended from the annular fitting sleeve 28.

Preferably, as particularly shown in FIG. 4, the length of the first tube 41 is longer than the lengths of the second 42 and third 43 tubes. Ideally, the length of the second tube 42 is about two thirds the length of the first tube 41 while the length of the third tube 43 is about one third the length of the first tube 41.

As illustrated in FIG. 3, the housing 30 has a connecting portion 36, a substantially transparent lower portion 32, and an upper lamp shade portion 34. The upper lamp shade portion 34 is detachably mounted to the lower portion 32 so that together they define a housing hollow interior 35. Within the housing hollow interior 35 is a light source 12 for providing light that is also mounted to the lower portion 32 of the housing 30.

The connecting portion 36 of the housing 30 is downwardly extended from the lower portion 32 of the housing 30. The connecting portion 36 has a threaded bore 37 which is threadably engagable to the threads 46 on the upper ends 45 of each of the tubes 40 to permit detachable coupling of the connecting portion 36 to the upper ends 45 of each the tube 40.

Ideally, as shown in FIG. 3, the lamp 10 includes an elongate flexible electrical power supply cord 14 downwardly extended from the connecting portion 36 of the housing 30. One end of the electrical power supply cord 14 is electrically coupled to the light source 12 while the other end of the electrical power supply cord 14 has a plug portion 15 for electrical coupling to a power source for proving power to the light source 12. The electrical power supply cord 14 is extendable into the hollow interior 44 of each the tube 40 when the upper end 45 of the tube 40 is coupled to the connecting portion 36 of the housing 30. This permits extension of the other end of the electrical power supply cord 14 through the slot 49 of the tube 40 so that the plug portion 15 can be plugged into an electrical outlet.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A lamp kit, comprising:

a base having a mounting portion and a resting flange;

said resting flange being radially extended from said mounting portion, said resting flange being for resting on a surface;

elongate first and second tubes, each said tube having a hollow interior, a length, and opposite upper and lower ends;

said lower end of each said tube having a slot into said hollow interior of said tube, said slot being extended towards said upper end of said tube;

said lower end of each said tube being mountable to said mounting portion of said base;

said upper end of each said tube having an opening into said hollow interior of said tube;

a housing having a substantially transparent lower portion, and an upper lamp shade portion;

said lower portion of said housing and said upper lamp shade portion of said housing defining a housing hollow interior, said upper lamp shade portion of said housing being detachably mounted on said lower portion of said housing portion;

said lower portion of said housing being detachably couplable to said upper ends of each said tube; and a light source being disposed within said housing hollow interior, said light source being mounted to said lower portion of said housing.

2. The lamp kit of claim 1, further comprising an elongate annular fitting sleeve defining a bore extending therethrough, wherein said mounting portion has a receiving bore;

wherein said annular fitting sleeve is inserted into said receiving bore of said mounting portion of said base; and wherein said lower end of each said tube is insertable into said bore of said annular fitting sleeve to mount said tube on said mounting portion of said base, a portion of said slot of tube being upwardly extended from said annular fitting sleeve.

3. The lamp kit of claim 1, further comprising a plurality of spaced apart mounting spikes being downwardly extended from said resting flange, said mounting spikes being positioned towards the outer periphery of said resting flange, said mounting spikes being for insertion into a ground surface.

4. The lamp kit of claim 1, wherein said length of said first tube is longer than said length of said second tube.

5. The lamp kit of claim 4, further comprising an elongate third tube, and wherein said length of said first tube is longer than said lengths of said second and third tubes.

6. The lamp kit of claim 1, wherein said length of said second tube is about two thirds said length of said first tube, said length of said third tube is about one third said length of said first tube.

7. The lamp kit of claim 1, wherein said tubes are cylindrical.

8. The lamp kit of claim 1, wherein said housing has connecting portion;

wherein said upper end of each said tube has an opening into said hollow interior of said tube, said upper end of each said tube being threaded; and wherein said connecting portion of said housing has a threaded bore, said connecting portion of said housing being downwardly extended from said lower portion of said housing, said threaded bore of said connecting portion of said housing being threadably engagable to said threaded upper ends of each said tube to detachably couple said connecting portion to said upper ends of each said tube.

9. The lamp kit of claim 1, further comprising an elongate flexible electrical power supply cord having opposite ends, said electrical power supply cord being downwardly extended from said connecting portion of said housing, one said end of said electrical power supply cord being electrically coupled to said light source, the other said end of said electrical power supply cord having a plug portion for electrically coupling to a power source for proving power to said light source, said electrical power supply cord being extendable into said hollow interior of each said tube when said upper end of said tube is coupled to said connecting portion of said housing, said other said end of said electrical power supply cord being extendable through said slot of each said tube when said electrical power supply cord is extended into said hollow interior of said tube.

10. A lamp kit, comprising:

a base having a mounting portion and a resting flange;

said mounting portion having a receiving bore;

an elongate annular fitting sleeve defining a bore extending therethrough, said annular fitting sleeve being inserted into said receiving bore of said mounting portion of said base;

said resting flange being radially extended from said mounting portion, said resting flange being for resting on a surface;

a plurality of spaced apart mounting spikes being downwardly extended from said resting flange, said mounting spikes being positioned towards the outer periphery of said resting flange, said mounting spikes being for insertion into a ground surface;

elongate first, second and third tubes, said tubes being cylindrical, each said tube having a hollow interior, a length, and opposite upper and lower ends;

said lower end of each said tube having a slot into said hollow interior of said tube, said slot being extended towards said upper end of said tube;

said lower end of each said tube being insertable into said bore of said annular fitting sleeve to mount said tube on said mounting portion of said base, a portion of said slot of tube being upwardly extended from said annular fitting sleeve;

said upper end of each said tube having an opening into said hollow interior of said tube, said upper end of each said tube being threaded;

said length of said first tube being longer than said lengths of said second and third tubes, said length of said second tube being about two thirds said length of said first tube, said length of said third tube being about one third said length of said first tube;

a housing having connecting portion, a substantially transparent lower portion, an upper lamp shade portion;

said lower portion of said housing and said upper lamp shade portion of said housing defining a housing hollow interior, said upper lamp shade portion of said housing being detachably mounted on said lower portion of said housing portion;

said connecting portion of said housing having a threaded bore, said connecting portion of said housing being downwardly extended from said lower portion of said housing, said threaded bore of said connecting portion of said housing being threadably engagable to said threaded upper ends of each said tube to detachably couple said connecting portion to said upper ends of each said tube;

a light source being disposed within said housing hollow interior, said light source being mounted to said lower portion of said housing; and an elongate flexible electrical power supply cord having opposite ends, said electrical power supply cord being downwardly extended from said connecting portion of said housing, one said end of said electrical power supply cord being electrically coupled to said light source, the other said end of said electrical power supply cord having a plug portion for electrically coupling to a power source for proving power to said light source, said electrical power supply cord being extendable into said hollow interior of each said tube when said upper end of said tube is coupled to said connecting portion of said housing, said other said end of said electrical power supply cord being extendable through said slot of each said tube when said electrical power supply cord is extended into said hollow interior of said tube.

* * * * *